US011413478B2

(12) United States Patent
Bina et al.

(10) Patent No.: US 11,413,478 B2
(45) Date of Patent: Aug. 16, 2022

(54) MULTI-PURPOSE ILLUMINATION, SELF-DEFENSE AND GLASS-BREAKING TOOL

(71) Applicants: Robert E. Bina, Quincy, MA (US); Peter E. Schuerch, Quincy, MA (US)

(72) Inventors: Robert E. Bina, Quincy, MA (US); Peter E. Schuerch, Quincy, MA (US)

( * ) Notice: Subject to any disclaimer, the term of this patent is extended or adjusted under 35 U.S.C. 154(b) by 0 days.

(21) Appl. No.: 17/147,624

(22) Filed: Jan. 13, 2021

(65) Prior Publication Data

US 2021/0213308 A1 Jul. 15, 2021

Related U.S. Application Data

(60) Provisional application No. 62/961,366, filed on Jan. 15, 2020.

(51) Int. Cl.

| | |
|---|---|
| ***A62B 3/00*** | (2006.01) |
| ***F21V 33/00*** | (2006.01) |
| ***F41H 9/10*** | (2006.01) |

(52) U.S. Cl.

CPC ..... *A62B 3/005* (2013.01); *F21V 33/0064* (2013.01); *F41H 9/10* (2013.01)

(58) Field of Classification Search

CPC ..... A62B 3/005; F21V 33/0064; F41H 9/10; B25F 1/00; B25F 1/006

USPC ..... 362/119

See application file for complete search history.

(56) References Cited

U.S. PATENT DOCUMENTS

| | | | | |
|---|---|---|---|---|
| 4,186,851 | A * | 2/1980 | Cantor | F21V 33/0076 222/113 |
| 5,331,523 | A * | 7/1994 | Delzer | F21V 33/0064 222/113 |
| 5,673,819 | A * | 10/1997 | Brunswig | F21V 33/0064 222/113 |
| 5,893,483 | A * | 4/1999 | Duran | F41H 9/10 222/39 |
| 7,121,432 | B2 * | 10/2006 | Kostal | F41H 9/10 222/192 |
| 7,126,484 | B1 * | 10/2006 | Luquire | B26B 1/10 340/574 |
| 7,524,076 | B2 * | 4/2009 | Kukuk | F41C 23/10 362/109 |
| 7,559,439 | B2 * | 7/2009 | Cellini | F41B 15/02 222/113 |
| 7,787,232 | B2 * | 8/2010 | Abatemarco | A45B 3/04 361/232 |
| 9,032,594 | B1 * | 5/2015 | Mitchell | F16B 45/04 24/599.3 |

(Continued)

FOREIGN PATENT DOCUMENTS

CN 107497072 A * 12/2017

OTHER PUBLICATIONS

Translated description of CN107497072 (Year: 2021).*

(Continued)

*Primary Examiner* — Lee D Wilson
*Assistant Examiner* — Jacob Adam Montgomery
(74) *Attorney, Agent, or Firm* — Pandiscio & Pandiscio

(57) ABSTRACT

A multi-purpose illumination, self-defense and glass-breaking tool, the tool comprising: a tool body; a handle projecting from the tool body; a flashlight carried by the tool body; a pepper spray unit carried by the tool body; and a glass breaker carried by the handle.

12 Claims, 10 Drawing Sheets

(56) References Cited

U.S. PATENT DOCUMENTS

| | | | | |
|---|---|---|---|---|
| 9,279,642 | B2 * | 3/2016 | Rowlett | F41H 9/10 |
| 10,139,101 | B2 * | 11/2018 | Pires | F21V 33/0076 |
| 10,816,020 | B2 * | 10/2020 | Chen | F21V 33/0064 |
| 2004/0184260 | A1 * | 9/2004 | Kukuk | F21V 33/0064 362/96 |
| 2010/0237103 | A1 * | 9/2010 | Habermann | F41H 9/10 222/183 |
| 2016/0010847 | A1 * | 1/2016 | Bellows | F41B 15/06 362/96 |
| 2016/0153487 | A1 * | 6/2016 | Hollinger | F16B 45/02 24/376 |
| 2018/0303408 | A1 * | 10/2018 | Troy | A61B 5/055 |
| 2019/0271527 | A1 * | 9/2019 | Nangunoori | G08B 25/016 |
| 2019/0308213 | A1 * | 10/2019 | Mispel-Beyer | F41C 23/16 |

OTHER PUBLICATIONS https://mojagear.com/gear-you-gotta-get-new-black-diamond-magnetron-auto-locking-carabiners-review/ (Year: 2016).*

Black Diamond Magnetron Technology Magnetic Locking Carabiner—YouTube Video https://www.youtube.com/watch?v=TVQXLNYdgy4 (Year: 2015).*

* cited by examiner

MULTI-PURPOSE ILLUMINATION, SELF-DEFENSE AND GLASS-BREAKING TOOL

REFERENCE TO PENDING PRIOR PATENT APPLICATION

This patent application claims benefit of prior U.S. Provisional Patent Application Ser. No. 62/961,366, filed Jan. 15, 2020 by Robert E. Bina et al. for MULTI-PURPOSE SELF-DEFENSE AND SAFETY TOOL, which patent application is hereby incorporated herein by reference.

FIELD OF THE INVENTION

This invention relates to multi-purpose tools in general, and more particularly to multi-purpose tools for illumination, self-defense and glass-breaking.

BACKGROUND OF THE INVENTION

In many circumstances a person may need illumination, such as at night, or when in a dark building, etc. In this case, a flashlight or the like may be useful.

And in many circumstances a person may need self-defense capabilities, such as to fend off an assailant. In this case, a pepper spray unit may be extremely important.

And in certain circumstances, a person may need glass-breaking capabilities, such as when the person needs to quickly exit a motor vehicle. In this case, a glass-breaking tool may be critical.

And in some circumstances, a person may need some combination of one or more of illumination, self-defense capabilities and/or glass-breaking capabilities. In such a situation, the need to locate and handle two or more separate, single-purpose devices can be a severe hindrance to rapidly achieving the desired illumination, self-defense and glass-breaking capability. This is especially true in emergency situations where time is of the essence, and where fumbling with multiple, single-purpose devices can hinder rapid access to illumination, self-defense and glass-breaking capability.

Thus there is a need for a new multi-purpose illumination, self-defense and glass-breaking tool which can provide, in a single device, illumination, self-defense capability and/or glass-breaking capability.

SUMMARY OF THE INVENTION

The present invention comprises the provision and use of a new multi-purpose illumination, self-defense and glass-breaking tool which can provide, in a single device, illumination, self-defense capability and glass-breaking capability.

Significantly, the user is able to wield and operate the multi-purpose tool with one hand without the need to actively grip the multi-purpose tool with their fingers, leaving their fingers free to grab keys, open a door, hold a gun, etc.

In one form of the invention, there is provided a multi-purpose illumination, self-defense and glass-breaking tool, the tool comprising:

a tool body;

a handle projecting from the tool body;

a flashlight carried by the tool body;

a pepper spray unit carried by the tool body; and a glass breaker carried by the handle.

In another form of the invention, there is provided a method for providing at least one of illumination, pepper spray dispensing and glass-breaking capability, the method comprising:

providing a multi-purpose illumination, self-defense and glass-breaking tool, the tool comprising:

a tool body;

a handle projecting from the tool body;

a flashlight carried by the tool body;

a pepper spray unit carried by the tool body; and a glass breaker carried by the handle;

engaging the handle of the tool with the fingers of a user; and taking at least one of the following actions:

(i) providing illumination via the flashlight;

(ii) dispensing pepper spray from the pepper spray unit; and (iii) breaking glass by driving the glass breaker against glass.

BRIEF DESCRIPTION OF THE DRAWINGS

These and other objects and features of the present invention will be more fully disclosed or rendered obvious by the following detailed description of the preferred embodiments of the invention, which is to be considered together with the accompanying drawings wherein like numbers refer to like parts, and further wherein.

DETAILED DESCRIPTION OF THE PREFERRED EMBODIMENTS

Figure 1:
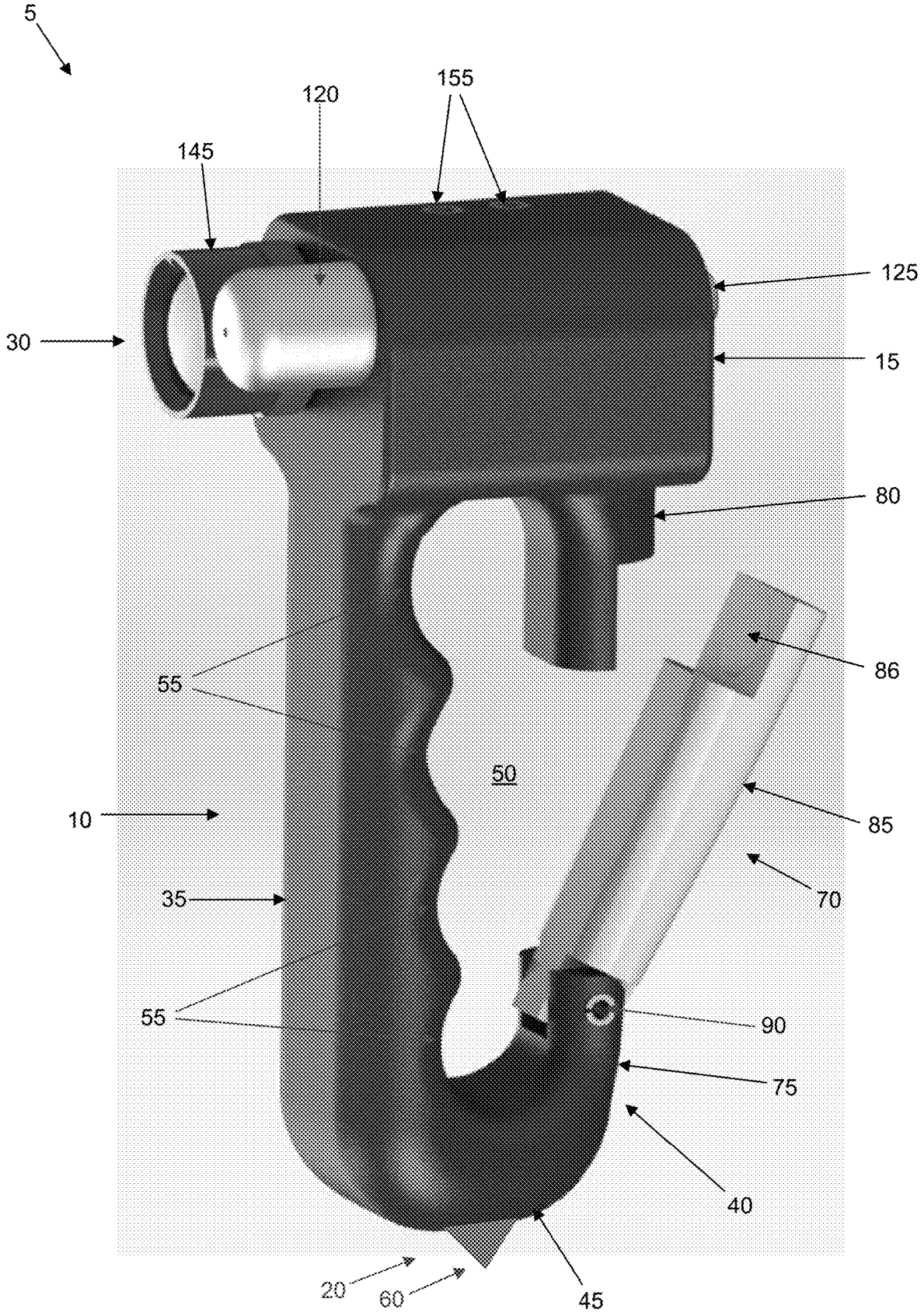
FIGS. 1-5 are schematic views showing a novel multi-purpose illumination, self-defense and glass-breaking tool formed in accordance with the present invention.
Figure 2:
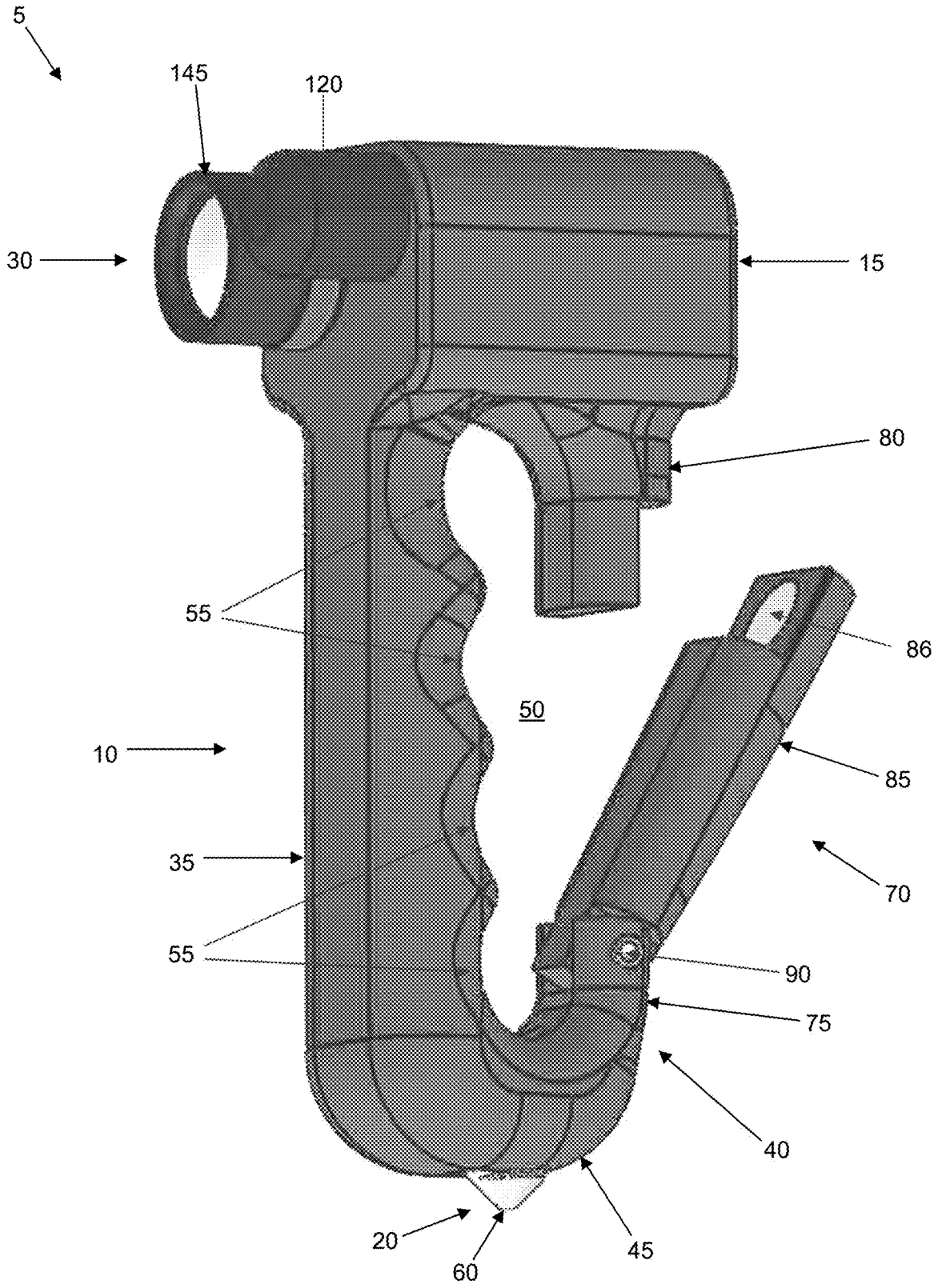
Figure 3:
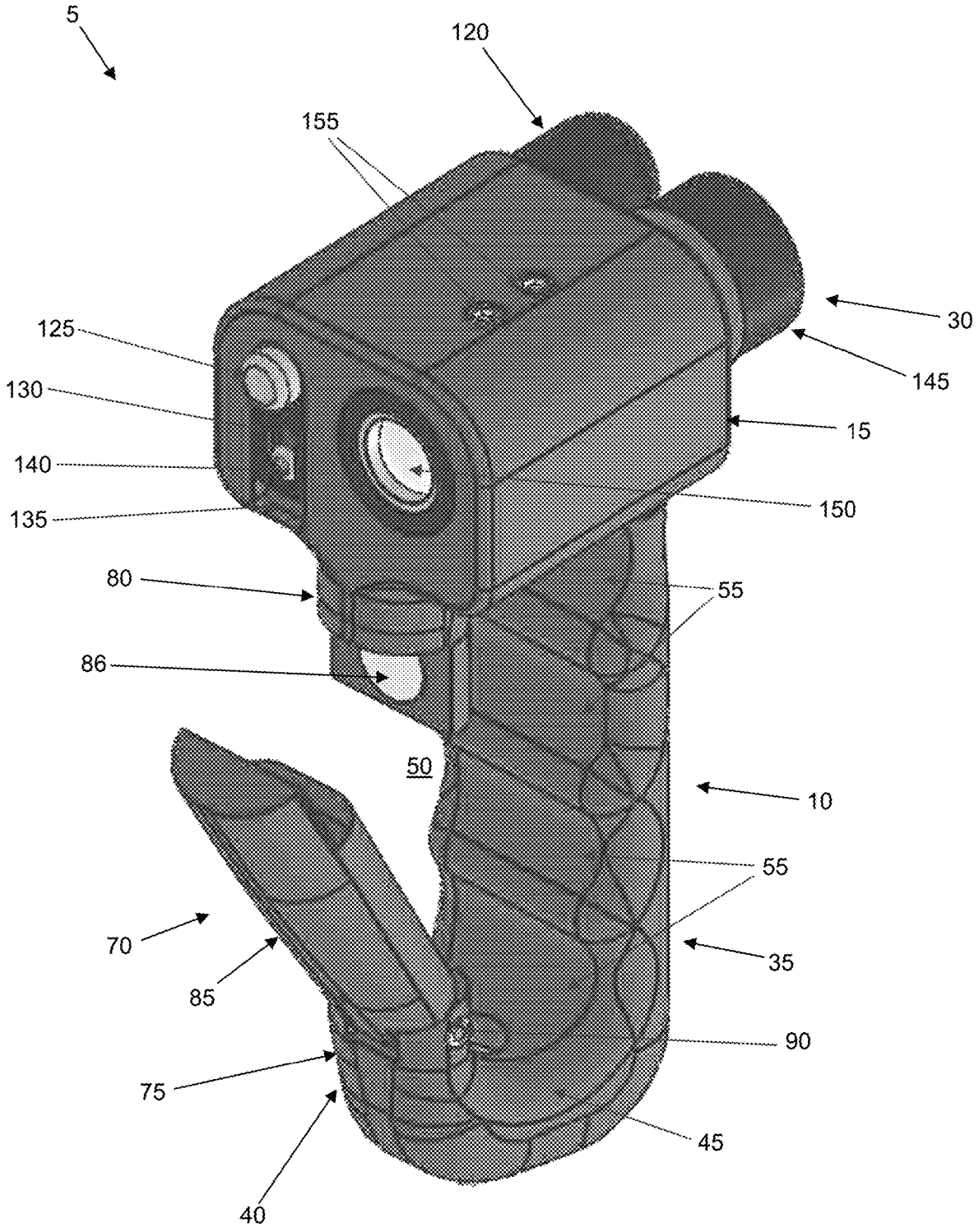
Figure 4:
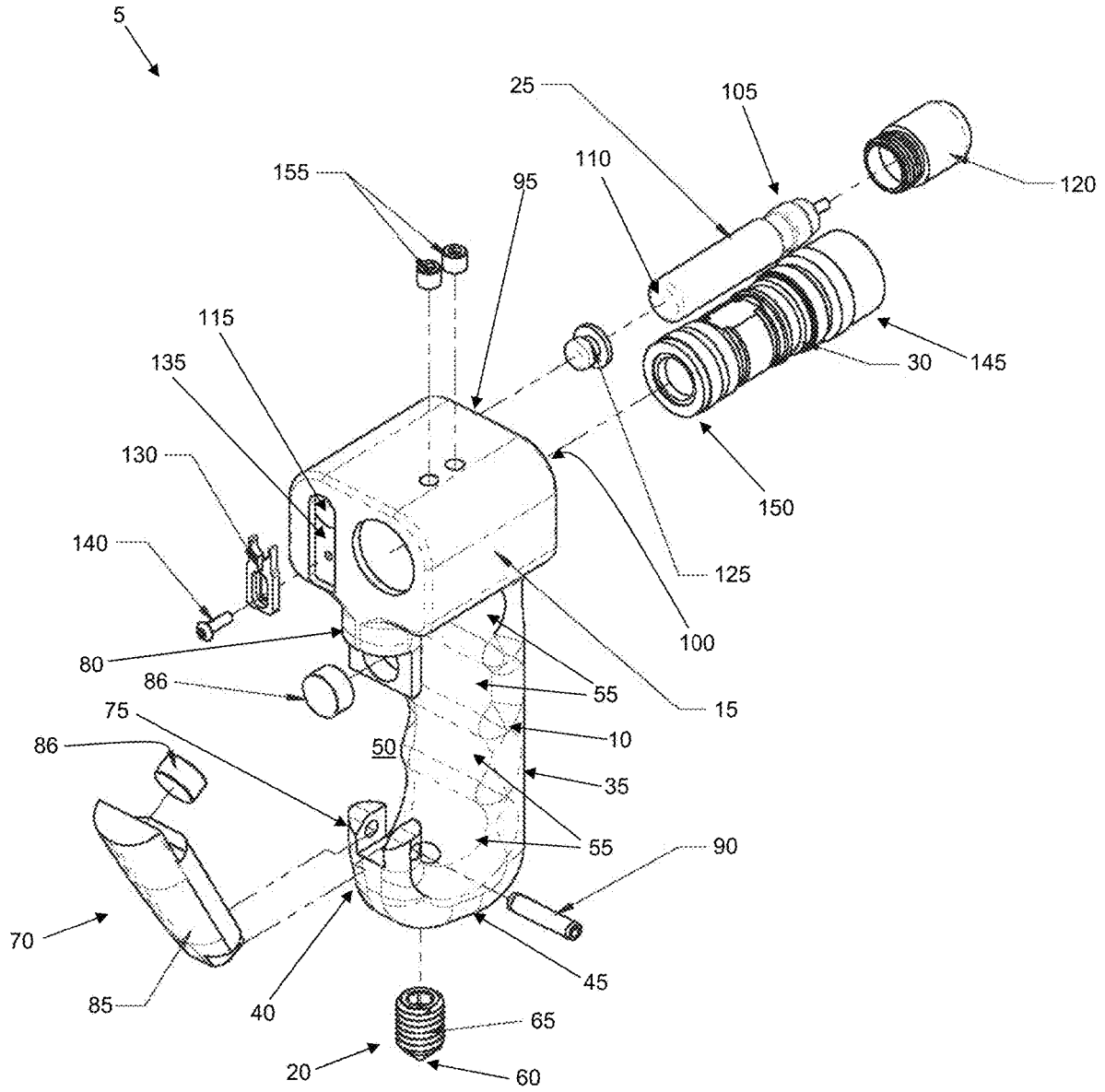
Figure 5:
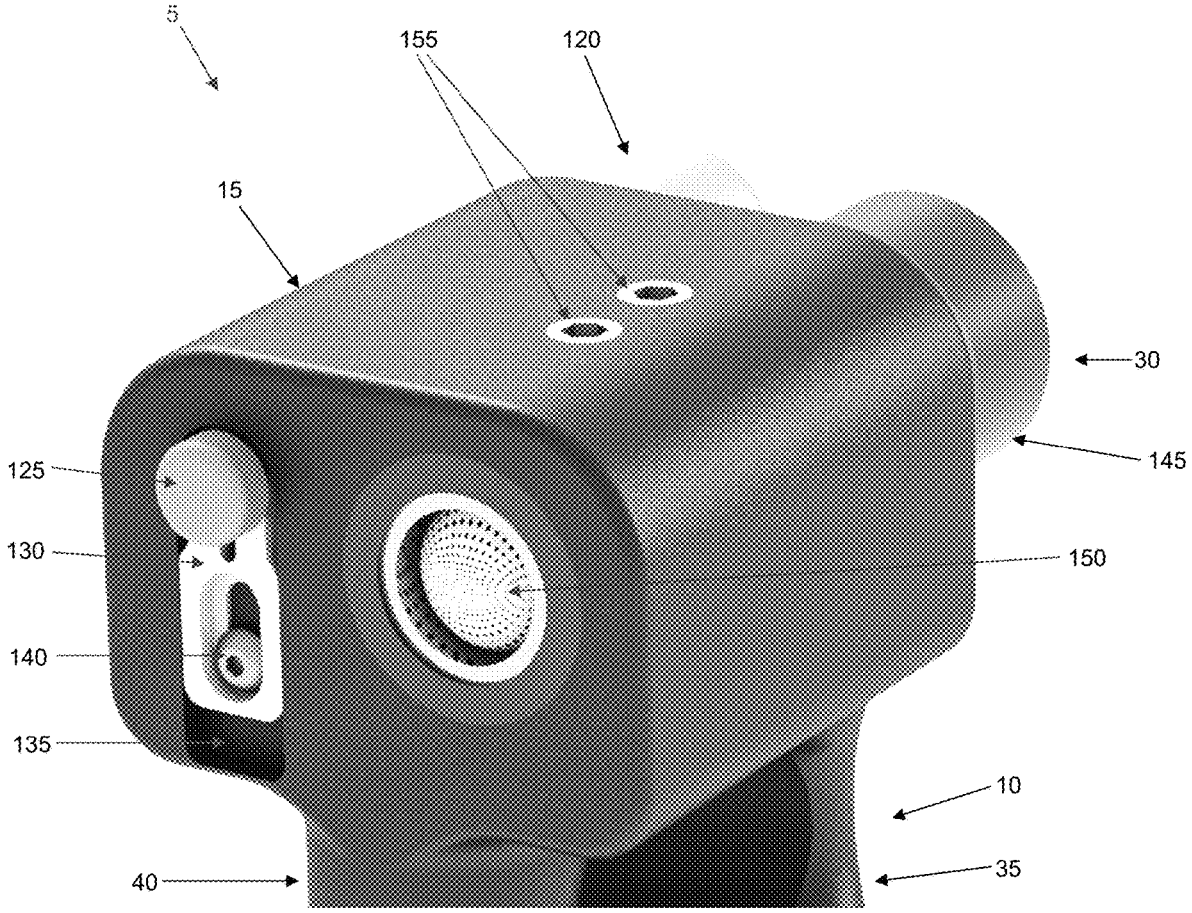
Figure 6:
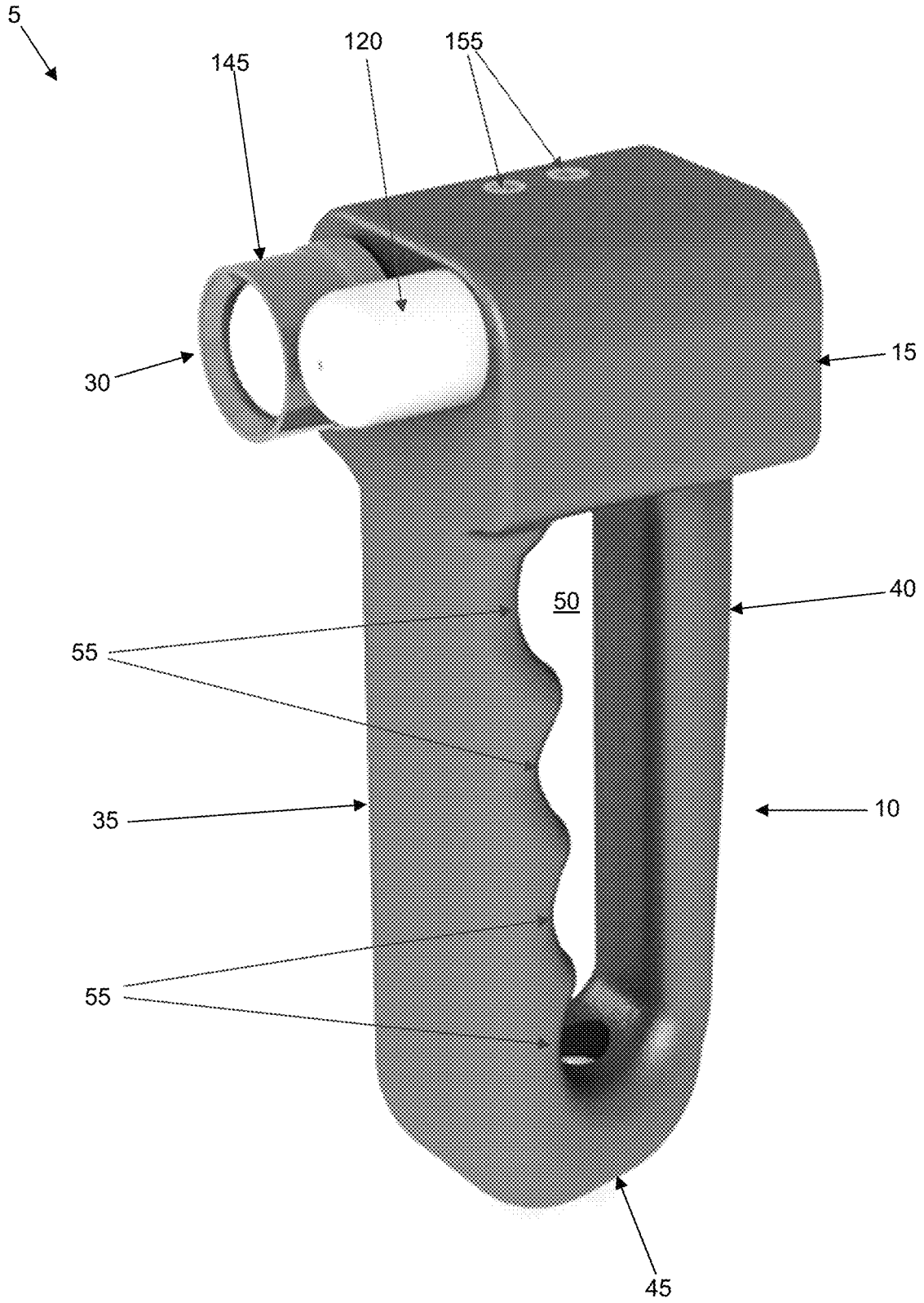
FIGS. 6-10 are schematic views showing another novel multi-purpose illumination, self-defense and glass-breaking tool formed in accordance with the present invention.
Figure 7:
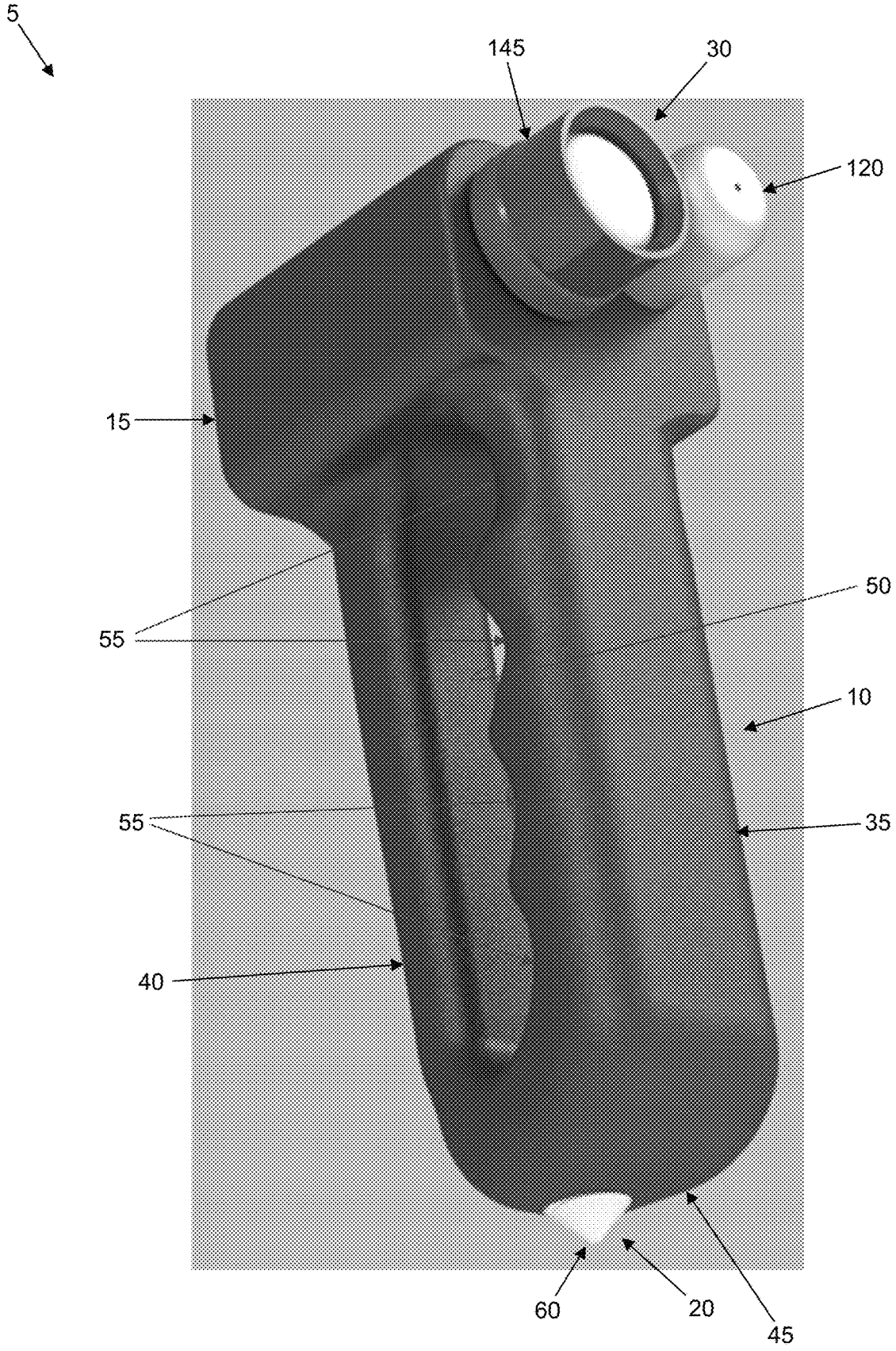
Figure 8:
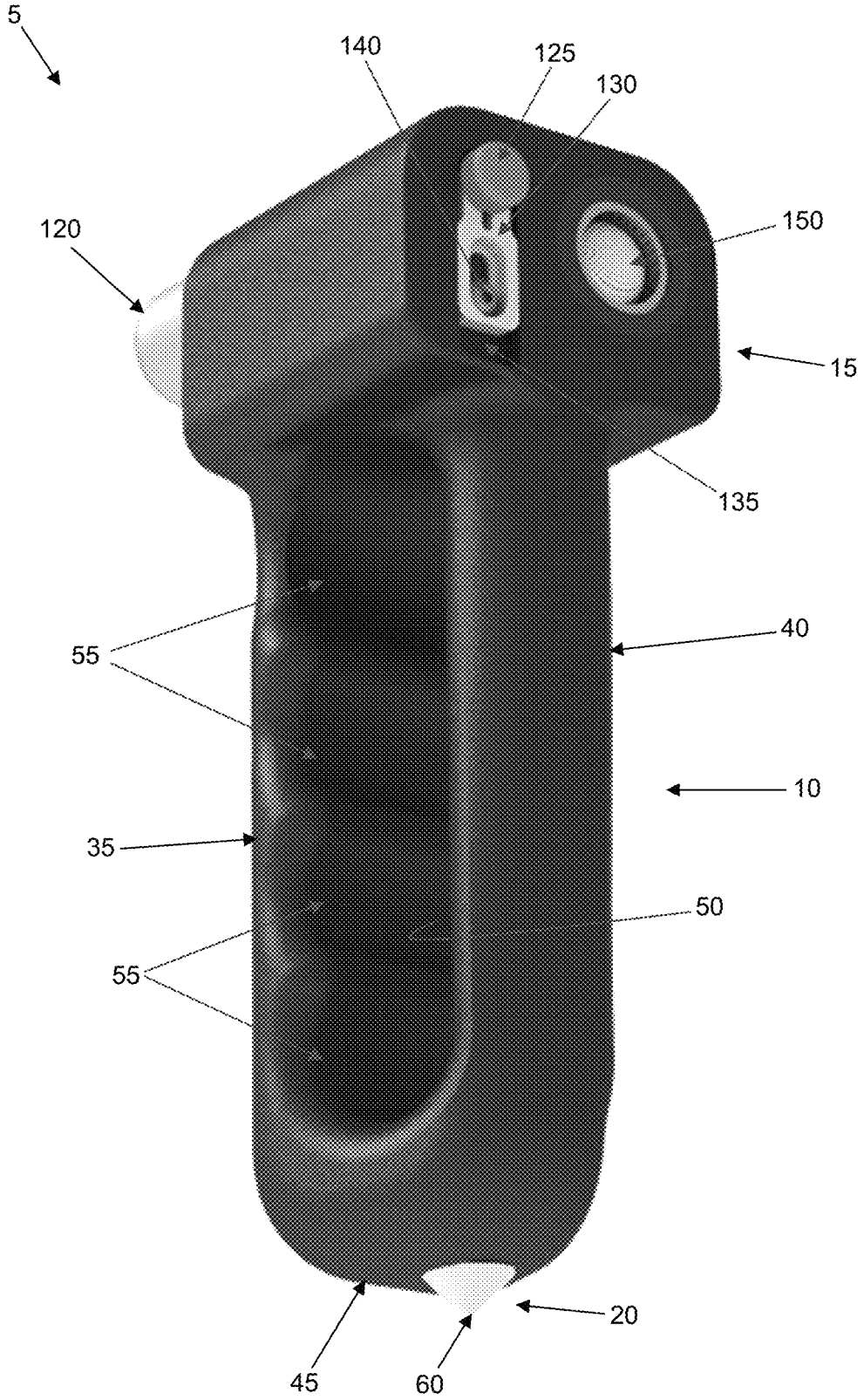
Figure 9:
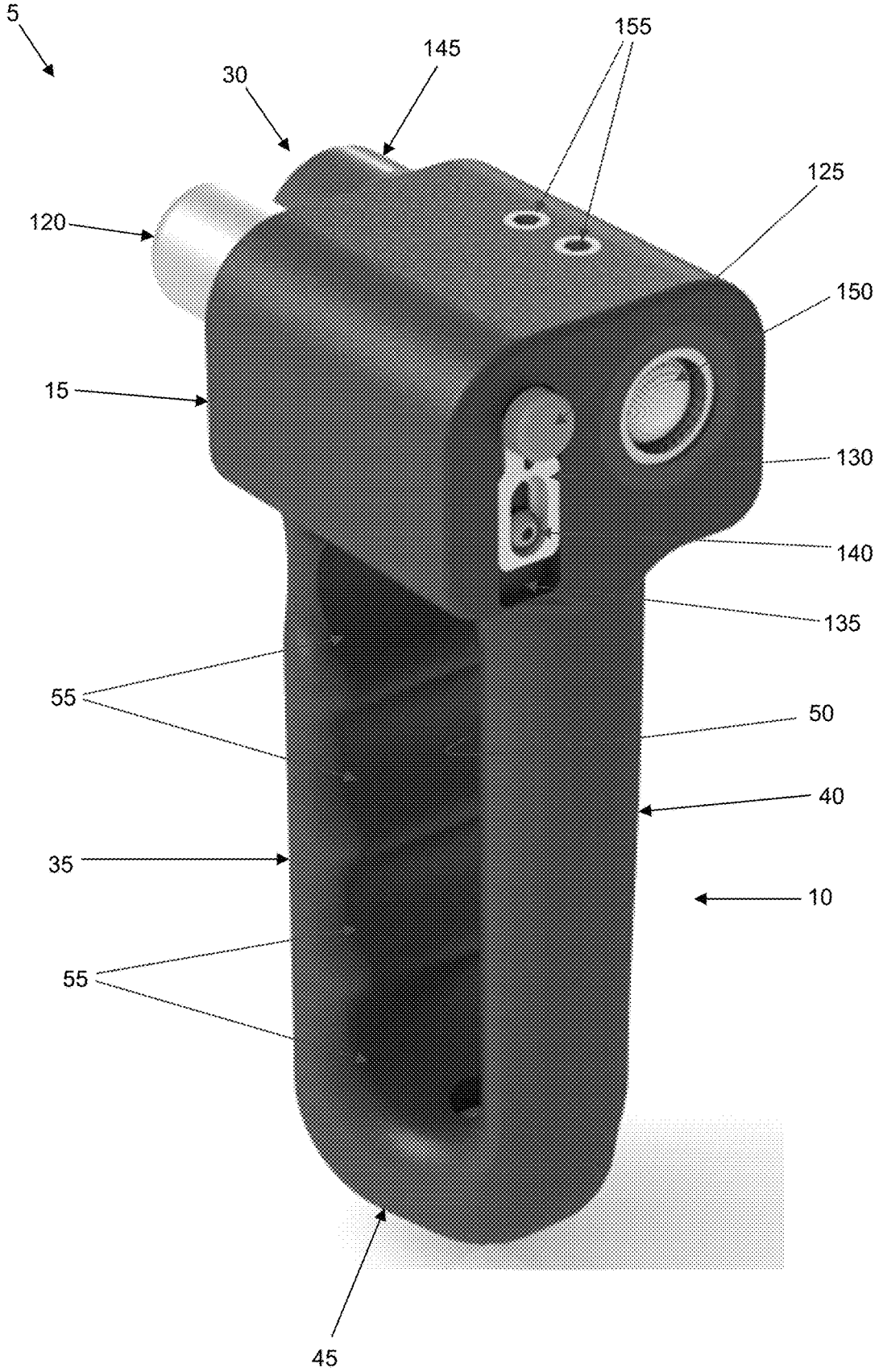
Figure 10:
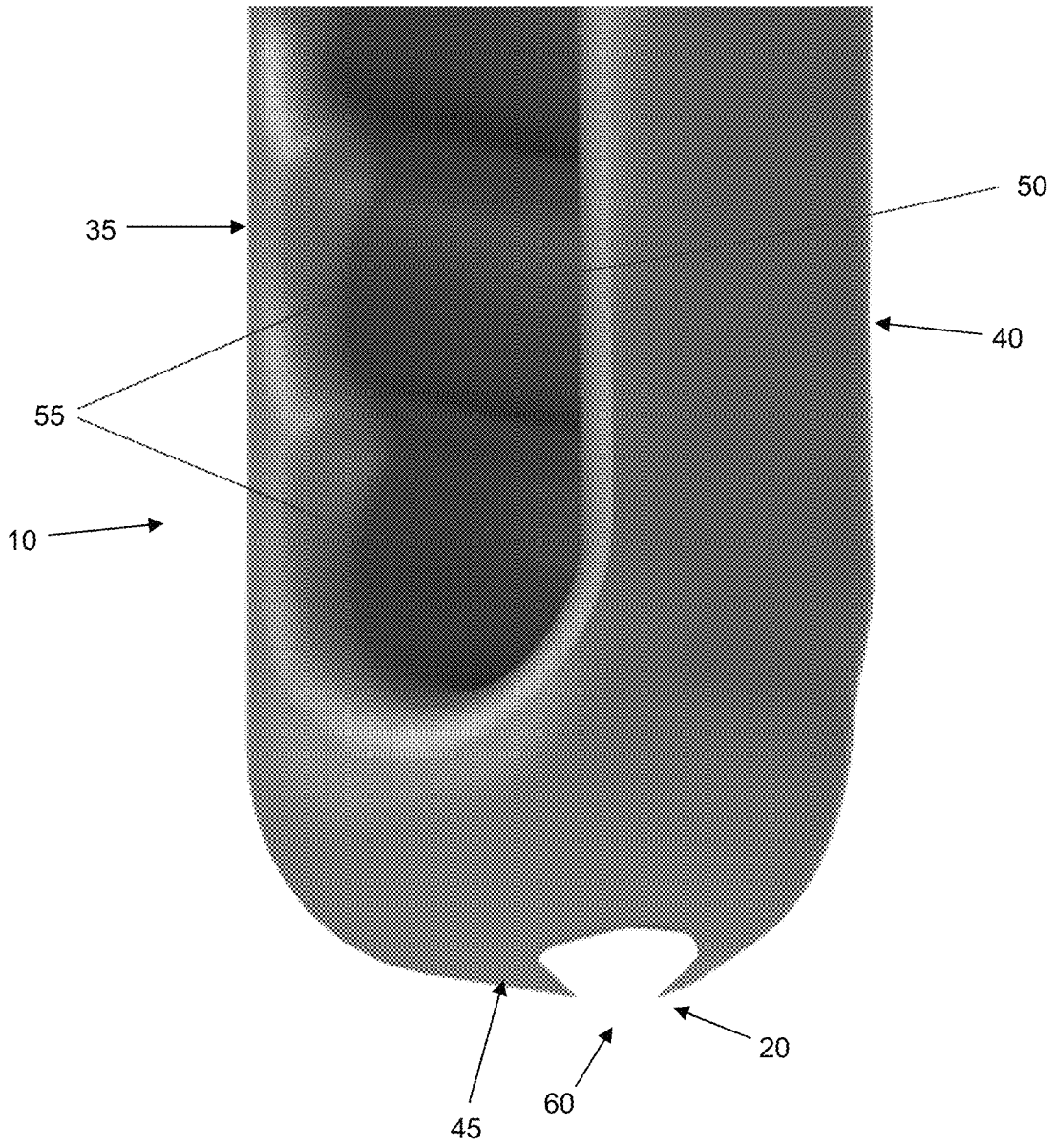

The present invention comprises the provision and use of a novel multi-purpose illumination, self-defense and glass-breaking tool 5 shown in FIGS. 1-5 and 6-10.

Looking first at FIGS. 1-5, multi-purpose illumination, self-defense and glass-breaking tool 5 generally comprises a handle 10 extending from a tool body 15, wherein handle 10 carries a glass breaker 20, and wherein tool body 15 carries a pepper spray unit 25 and a flashlight 30.

More particularly, handle 10 is formed with a "U" shape which projects from the bottom of tool body 15. The "U" shape of handle 10 is formed by a front leg 35 and a rear leg 40, both of which project downward from the bottom of tool body 15, and a closed bottom connector 45 which extends between the bottom portions of front leg 35 and rear leg 40. The "U" shape of handle 10 in turn creates an interior space 50 which is sized to receive the four fingers of a user's hand, with the heel of the hand resting against rear leg 40. In one form of the invention, interior space 50 is sized to closely receive the four fingers of a user's hand. In order to improve the fit and prevent slippage of the user's fingers within interior space 50, grooves 55 may be provided on the inward-facing surface of front leg 35 in order to closely contour-mate front leg 35 with the four fingers of the user's hand. Significantly, with such a construction, multi-purpose illumination, self-defense and glass-breaking tool 5 can be maintained on the user's hand solely by the fit of handle 10 around the user's fingers (i.e., the user does not need to actively grip rear leg 40 of handle 10 with the four fingers of his/her hand). It will be appreciated that, without the need for the user to actively grip rear leg 40 of handle 10 with the four fingers of his/her hand, the four fingers of the user's hand are free to grab keys, open a door, hold a gun, etc., while the user wields multi-purpose illumination, self-defense and glass-breaking tool 5.

On the bottom side of closed bottom connector 45, there is provided a glass breaker 20 for use in breaking glass, e.g., vehicle windows in the case of an emergency. Glass breaker 20 comprises a cone-shaped point 60 extending from a threaded body 65.

Glass breaker 20 may comprise a ½-13×¾" cone point set screw sold by McMaster Carr. Threaded body 65 is preferably completely received by closed bottom connector 45 of handle 10 such that only point 60 protrudes outward from closed bottom connector 45. Point 60 provides a small surface area onto which the force generated from a user swinging multi-purpose illumination, self-defense and glass-breaking tool 5 can be concentrated, thereby allowing the user to more readily break glass, e.g., a car window in the case of an emergency. To that end, glass breaker 20 is preferably made of a hard and strong material such as alloy steel, and handle 10 (and tool body 15) are preferably made of a durable material such as onyx nylon which can withstand the forces generated during the use of glass breaker 20 of multi-purpose illumination, self-defense and glass-breaking tool 5.

In one form of the invention, a latch 70 is provided on rear leg 40 of handle 10 so that handle 10 can act as a carabiner for clipping or hanging multi-purpose illumination, self-defense and glass-breaking tool 5 to another object (e.g., to a belt or to a loop provided on an article of clothing), or for clipping or hanging another object (e.g., a whistle on a short lanyard) to multi-purpose illumination, self-defense and glass-breaking tool 5. More specifically, rear leg 40 of handle 10 may comprise a bottom section 75 and a top section 80, with an arm 85 extending therebetween. One end of arm 85 is pivotally mounted to bottom section 75 of rear leg 40 by a spring pin 90 (e.g., a 3/16×7/8 spring pin sold by McMaster Carr) such that arm 85 is able to swing outward from top section 80, opening the "U" shape of handle 10 so that the interior space 50 of the handle can be accessed through latch 70 of rear leg 40, and then spring back into contact with top section 80 so as to restore the "U" shape of handle 10 (i.e., so that interior space 50 of the handle can no longer be accessed through latch 70 of rear leg 40). To help keep the "U" shape of handle 10 closed, a selective closure means 86 (e.g., NEO 35 (NdFeB) magnets sold by McMaster Carr) may be provided on top section 80 of rear leg 40 and the free end of arm 85.

Thus, where, for example, multi-purpose illumination, self-defense and glass-breaking tool 5 is to be clipped to the belt of a user, latch 70 is opened, handle 10 is moved so that the belt is passed through open latch 70, and then latch 70 is closed so as to securely clip multi-purpose illumination, self-defense and glass-breaking tool 5 to the belt of the user. When multi-purpose illumination, self-defense and glass-breaking tool 5 is thereafter to be used, latch 70 is opened, handle 10 is moved so that the belt is passed through open latch 70, latch 70 is closed so as to restore the normal "U" shape of handle 10, and then the fingers of the user are passed through interior space 50 so that multi-purpose illumination, self-defense and glass-breaking tool 5 is mounted to the fingers of the user. Furthermore, where, for example, multi-purpose illumination, self-defense and glass-breaking tool 5 is to have a whistle (on a short lanyard) clipped to handle 10, latch 70 is opened, the lanyard of the whistle is passed through open latch 70, and then latch 70 is closed so as to securely clip the lanyard of the whistle (and hence securely clip the whistle) to multi-purpose illumination, self-defense and glass-breaking tool 5. When the whistle is to be unclipped from multi-purpose illumination, self-defense and glass-breaking tool 5, latch 70 is opened, the lanyard of the whistle is passed through open latch 70, and latch 70 is closed, so as to restore the normal "U" shape of handle 10.

Looking next at tool body 15, tool body 15 comprises parallel, cylindrical cavities 95 and 100 sized to receive pepper spray unit 25 and flashlight 30, respectively. Cavities 95 and 100 (and therefore pepper spray unit 25 and flashlight 30) extend horizontally through tool body 15 from the front end of tool body 15 to the rear end of tool body 15. With pepper spray unit 25 and flashlight 30 in this orientation, the user is able to easily reach/operate the back ends of both pepper spray unit 25 and flashlight 30 with his/her thumb of the same hand which holds multi-purpose illumination, self-defense and glass-breaking tool 5. Hence, multi-purpose illumination, self-defense and glass-breaking tool 5 can be held and fully operated with one hand.

With respect to pepper spray unit 25, pepper spray unit 25 comprises a replaceable pepper spray canister (e.g., a pepper spray Spitfire Refill Unit sold by Sabre Red, or another pepper spray refill unit available from Sabre Red or another manufacturer) having a front end 105 from which pepper spray fluid is discharged, and a rear end 110 which the user can depress to initiate discharge of pepper spray fluid.

Pepper spray unit 25 is loaded, rear end 110 first, into the front end of cavity 95 until pepper spray unit 25 reaches a narrowed opening 115 at the rear of cavity 95. Narrowed opening 115 has a smaller diameter than pepper spray unit 25, whereby to prevent pepper spray unit 25 from sliding out of the rear end of cavity 95. Pepper spray unit 25 is then secured within cavity 95 by screwing a threaded nozzle extender 120 onto the front end of cavity 95.

To initiate discharge of pepper spray fluid from pepper spray unit 25, rear end 110 of pepper spray unit 25 must be pressed toward the remainder of pepper spray unit 25, i.e., rear end 110 must be pushed forward. This is facilitated by a push button 125 extending through narrowed opening 115 of cavity 95. Pressing push button 125 forward against rear end 110 of pepper spray unit 25 causes pepper spray fluid to be discharged out the front of pepper spray unit 25. However, a safety stop 130 is preferably also provided to prevent the user from accidentally discharging pepper spray fluid with an errant press of push button 125. More particularly, safety stop 130 is slidably held within a vertical slot 135 on the rear face of tool body 15 by a pin 140 (e.g., a 4-40×3/8 BH screw sold by McMaster Carr), and is moveable between an "inactive" position (the "up" position in the frame of reference of FIGS. 3-5) in which safety stop 130 prevents push button 125 from pressing against rear end 110 of pepper spray unit 25, and an "active" position (the "down" position in the frame of reference of FIGS. 3-5) in which push button 125 may be pressed against rear end 110 of pepper spray unit 25. Thus, in its "inactive" position, safety stop 130 holds push button 125 so that push button 125 is not able to press against rear end 110 of pepper spray unit 25. Therefore, if the user were to depress push button 125 while safety stop 130 is in its "inactive" position, push button 125 would not engage rear end 110 of pepper spray unit 25 and no pepper spray fluid would be discharged. In order to dispense pepper spray fluid, the user must first move safety stop 130 into its "active" position wherein push button 125 is able to press against rear end 110 of pepper spray unit 25. This is done by moving safety stop 130 downward along vertical slot 135. After moving safety stop 130 down into the "active" position, the user is able to spray pepper spray fluid by depressing rear end 110 of pepper spray unit 25 via push button 125.

With respect to flashlight 30, flashlight 30 comprises a cyclindrical flashlight (e.g., a Redline tactical flashlight sold by NEBO, or another flashlight available from NEBO or another manufacturer) having a front end 145 from which light is emitted and a rear end 150 by which operation of flashlight 30 is controlled (e.g., turning the flashlight on/off, dimming, changing flash patterns, etc. by pushing on a button provided on rear end 150). Flashlight 30 is loaded, rear end 150 first, into the front end of cavity 100 until flashlight 30 is flush, or near flush, to the rear face of tool body 15. Flashlight 30 is then secured within cavity 100 of tool body 15 by two set screws 155 (e.g., two ¼-20×¼ cup point set screws sold by McMaster Carr) which are advanced through the top of tool body 15 and which pinch down on flashlight 30 so as to secure flashlight 30 against movement relative to tool body 15.

In use, when multi-purpose illumination, self-defense and glass-breaking tool 5 is to be used, it is first held by one hand of a user, with the fingers of the user extending into interior space 50 of handle 10. Then, if multi-purpose illumination, self-defense and glass-breaking tool 5 is to be used to break glass (e.g., a car window in the case of an emergency), glass breaker 20 of multi-purpose illumination, self-defense and glass-breaking tool 5 is driven against the glass. Or if multi-purpose illumination, self-defense and glass-breaking tool 5 is to be used for personal defense, safety stop 130 is slid from its "inactive" position down to its "active" position, and then rear end 110 of pepper spray unit 25 is depressed via push button 125 so as to discharge pepper spray fluid from the front end 105 of pepper spray unit 25. Or if multi-purpose illumination, self-defense and glass-breaking tool 5 is to be used for illumination, rear end 150 of flashlight 30 is used to turn the flashlight on so that light is emitted from front end 145 of flashlight 30.

In an alternative form of the invention, and looking now at FIGS. 6-10, latch 70 may be omitted, i.e., rear leg 40 of handle 10 may be a single piece of material. In this case, handle 10 and tool body 15 may be formed integral with one another.

Modifications of the Preferred Embodiments

It should be understood that many additional changes in the details, materials, steps and arrangements of parts, which have been herein described and illustrated in order to explain the nature of the present invention, may be made by those skilled in the art while still remaining within the principles and scope of the invention.

What is claimed is:

1. A multi-purpose illumination, self-defense and glass-breaking tool, said tool comprising:

a tool body, wherein said tool body comprises a proximal end, a distal end, a first cavity opening on the proximal end and the distal end and a second cavity opening on the proximal end and the distal end, wherein said first cavity is configured to receive a pepper spray unit, and further wherein said second cavity is configured to receive a flashlight;

a handle extending downward from said tool body, wherein said handle comprises a front leg, a rear leg and a bottom portion connecting said front leg to said rear leg, wherein a cavity is formed between said tool body, said front leg, said rear leg and said bottom portion, wherein said front leg comprises grooves facing the cavity;

a flashlight carried by said tool body;

a pepper spray unit carried by said tool body; and a glass breaker carried on said bottom portion of said handle.

2. A tool according to claim 1 wherein a portion of said rear leg is pivotally mounted to the handle such that said rear leg is pivotable between an open cavity position and a closed cavity position.

3. A tool according to claim 2 wherein said rear leg is spring-biased to said closed cavity position.

4. A tool according to claim 2 wherein a magnet is provided on a portion of said handle to help keep said rear leg in the closed cavity position.

5. A tool according to claim 1 wherein said glass breaker comprises a cone-shaped point extending from a threaded body, and further wherein said threaded body is received in said bottom portion of said handle.

6. A tool according to claim 1 wherein said glass breaker comprises alloy steel.

7. A tool according to claim 1 wherein said tool body and said handle comprise a carbon fiber filled nylon.

8. A tool according to claim 1 wherein said pepper spray unit is held within said first cavity by securing a nozzle extender to said distal end of said tool body.

9. A tool according to claim 1 wherein a push button is moveably disposed on said tool body for actuating said pepper spray unit, and further wherein a safety stop is provided for selectively preventing said push button from actuating said pepper spray unit.

10. A tool according to claim 9 wherein said safety stop is slidably disposed in a slot on said proximal end of said tool body, and further wherein said safety stop is movable between (i) an "inactive" position in which said safety stop prevents said push button from actuating said pepper spray unit, and (ii) an "active" position in which said safety stop allows said push button to actuate said pepper spray unit.

11. A tool according to claim 1 wherein said flashlight is held within said second cavity by set screws.

12. A method for providing at least one of illumination, pepper spray dispensing and glass-breaking capability, said method comprising:

providing a multi-purpose illumination, self-defense and glass-breaking tool, said tool comprising:

a tool body, wherein said tool body comprises a proximal end, a distal end, a first cavity opening on the proximal end and the distal end and a second cavity opening on the proximal end and the distal end, wherein said first cavity is configured to receive a pepper spray unit, and further wherein said second cavity is configured to receive a flashlight;

a handle extending downward from said tool body, wherein said handle comprises a front leg, a rear leg and a bottom portion connecting said front leg to said rear leg, wherein a cavity is formed between said tool body, said front leg, said rear leg and said bottom portion, wherein said front leg comprises grooves facing the cavity;

a flashlight carried by said tool body;

a pepper spray unit carried by said tool body; and a glass breaker carried by said handle;

passing four fingers of a hand of a user through said cavity of said handle of said tool; and taking at least one of the following actions:

(i) providing illumination via said flashlight;

(ii) dispensing pepper spray from said pepper spray unit; and (iii) breaking glass by driving said glass breaker against glass.

* * * * *